US010418744B2

(12) United States Patent
Ogashira

(10) Patent No.: US 10,418,744 B2
(45) Date of Patent: Sep. 17, 2019

(54) CONNECTOR

(71) Applicant: Sumitomo Wiring Systems, Ltd., Yokkaichi, Mie (JP)

(72) Inventor: Daisuke Ogashira, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 16/067,622

(22) PCT Filed: Jan. 13, 2017

(86) PCT No.: PCT/JP2017/000970
§ 371 (c)(1),
(2) Date: Jul. 2, 2018

(87) PCT Pub. No.: WO2017/122765
PCT Pub. Date: Jul. 20, 2017

(65) Prior Publication Data

US 2019/0006784 A1 Jan. 3, 2019

(30) Foreign Application Priority Data

Jan. 15, 2016 (JP) ..... 2016-005779

(51) Int. Cl.
*H01R 13/56* (2006.01)
*H01R 13/506* (2006.01)

(52) U.S. Cl.
CPC ..... *H01R 13/506* (2013.01); *H01R 13/56* (2013.01)

(58) Field of Classification Search
CPC .. H01R 13/5833; H01R 13/506; H01R 13/58; H01R 13/56
(Continued)

(56) References Cited

U.S. PATENT DOCUMENTS 5,957,719 A * 9/1999 Okabe ..... H01R 4/2466 439/404
6,478,608 B1 * 11/2002 Grant ..... H01R 13/506 439/456
(Continued)

FOREIGN PATENT DOCUMENTS

JP 5-290924 11/1992
JP 2009-32554 2/2009
(Continued)

OTHER PUBLICATIONS

International Search Report dated Mar. 21, 2017.

*Primary Examiner* — Gary F Paumen
(74) *Attorney, Agent, or Firm* — Gerald E. Hespos; Michael J. Porco; Matthew T. Hespos

(57) ABSTRACT

It is aimed to prevent separation of a cover (30) from a housing (10). The housing (10) includes lock receiving portions (21) on an outer side of a wire extending surface (13). The cover (30) is in the form of a cap for covering wires (80) extending from the wire extending surface (13) and includes a wire pull-out opening (35) configured such that the wires (80) are pulled out therethrough, an opening end (34) configured to contact the housing (10) along a front-rear direction, and locks (41) configured to restrict separation from the housing (10) by locking the lock receiving portions (21). The cover (30) includes a rib (37) serving as a forward movement restricting portion. The housing (10) includes opening restricting portions (23) arranged to contact and face a front end of the rib (37) and to face an outer surface of the cover (30).

4 Claims, 5 Drawing Sheets

(58) Field of Classification Search
USPC ..... 439/456, 459, 473
See application file for complete search history.

(56) References Cited

U.S. PATENT DOCUMENTS

| | | | | |
|---|---|---|---|---|
| 7,458,852 | B2 * | 12/2008 | Gunreben | H01R 13/447 439/596 |
| 2003/0176090 | A1 * | 9/2003 | Kozono | H01R 13/567 439/157 |
| 2004/0102082 | A1 * | 5/2004 | Tsuji | H01R 13/562 439/470 |
| 2006/0172612 | A1 * | 8/2006 | Wasalaski | H01R 13/447 439/752 |
| 2006/0228938 | A1 * | 10/2006 | Langolf | H01R 13/506 439/521 |
| 2006/0281350 | A1 * | 12/2006 | Yamamoto | H01R 13/4361 439/157 |
| 2008/0299812 | A1 * | 12/2008 | Miyamoto | H01R 13/506 439/353 |
| 2009/0029579 | A1 | 1/2009 | Hiramatsu | |
| 2011/0230106 | A1 * | 9/2011 | Shamoto | H01R 13/62938 439/892 |
| 2014/0322961 | A1 * | 10/2014 | Wu | H01R 13/506 439/456 |
| 2014/0342587 | A1 * | 11/2014 | Wu | H01R 13/447 439/135 |
| 2014/0342595 | A1 * | 11/2014 | Wu | H01R 13/5833 439/456 |
| 2015/0056846 | A1 * | 2/2015 | Kataoka | H01R 13/506 439/456 |
| 2017/0229805 | A1 * | 8/2017 | Yoshida | H01R 13/5213 |

FOREIGN PATENT DOCUMENTS

| | | |
|---|---|---|
| JP | 2012-94289 | 5/2012 |
| JP | 5012287 | 8/2012 |
| JP | 2014-238949 | 12/2014 |

* cited by examiner

CONNECTOR

BACKGROUND

Field of the Invention

The present invention relates to a connector.

Related Art

Japanese Unexamined Patent Publication No. H05-290924 discloses a connector that includes a connector housing from which a wire is pulled out, and a cap-like cover to be mounted on the connector housing. The cover covers the wire and includes a wire pull-out opening for pulling the wire to the outside. The connector housing includes a locking projection on an outer peripheral side, and the cover includes a box-shaped locking frame projecting toward the connector housing. The locking frame locks the locking projection to hold the cover on the connector housing.

In the above case, an excessive stress is generated in the cover when the pulled-out wire is swung a large amount and both side walls of the cover may expand. This may cause the locking frame to disengage from the locking projection and the cover may separate from the connector housing.

The present invention was completed on the basis of the above situation and aims to prevent the separation of a cover from a connector housing.

SUMMARY

The invention is directed to a connector with a housing having a wire extending surface and a lock receiving portion on an outer side of the wire extending surface. A cover in the form of a cap is provided for covering a wire extending from the wire extending surface. The cover includes a wire pull-out opening configured such that the wire is pulled out therethrough. The cover also has an opening end configured to contact the housing along a front-rear direction, and a lock configured to restrict separation from the housing by locking the lock receiving portion. The cover includes a forward movement restricting portion, and the housing includes an opening restricting portion arranged to face and contact a front end of the forward movement restricting portion and to face an outer surface of the cover.

The opening restricting portion is arranged to face the outer surface of the cover. Thus, even if the wire pulled out from the wire pull-out opening is swung and an external twisting force acts on the cover, the outer surface of the cover contacts the opening restricting portion to prevent expansion of the cover. As a result, a state where the lock locks the lock receiving portion is maintained and the cover cannot separate from the housing.

Further, the contact of the opening restricting portion with the front end of the forward movement restricting portion prevents a forward positional deviation of the cover with respect to the housing. The opening restricting portion has both a function of preventing a positional deviation of the cover and a function of preventing the expansion of the cover. Thus, an entire configuration can be simplified as compared to the case where both functions are provided individually.

The forward movement restricting portion may be a rib extending along an opening edge of the wire pull-out opening. According to this configuration, the shape of the wire pull-out opening is maintained by the forward movement restricting rib and the expansion of the cover is prevented more reliably. Further, the forward movement restricting portion has a function of maintaining the shape of the wire pull-out opening, a function of preventing a positional deviation of the cover and a function of preventing the expansion of the cover. Thus, the entire configuration can be more simplified.

The cover may have plural of the locks, and the opening restricting portions may be at positions corresponding to the respective locks. By arranging the opening restricting portions at the positions corresponding to the respective locks in this way, the state where the locks lock the lock receiving portions is maintained more reliably.

DETAILED DESCRIPTION

Figure 2:
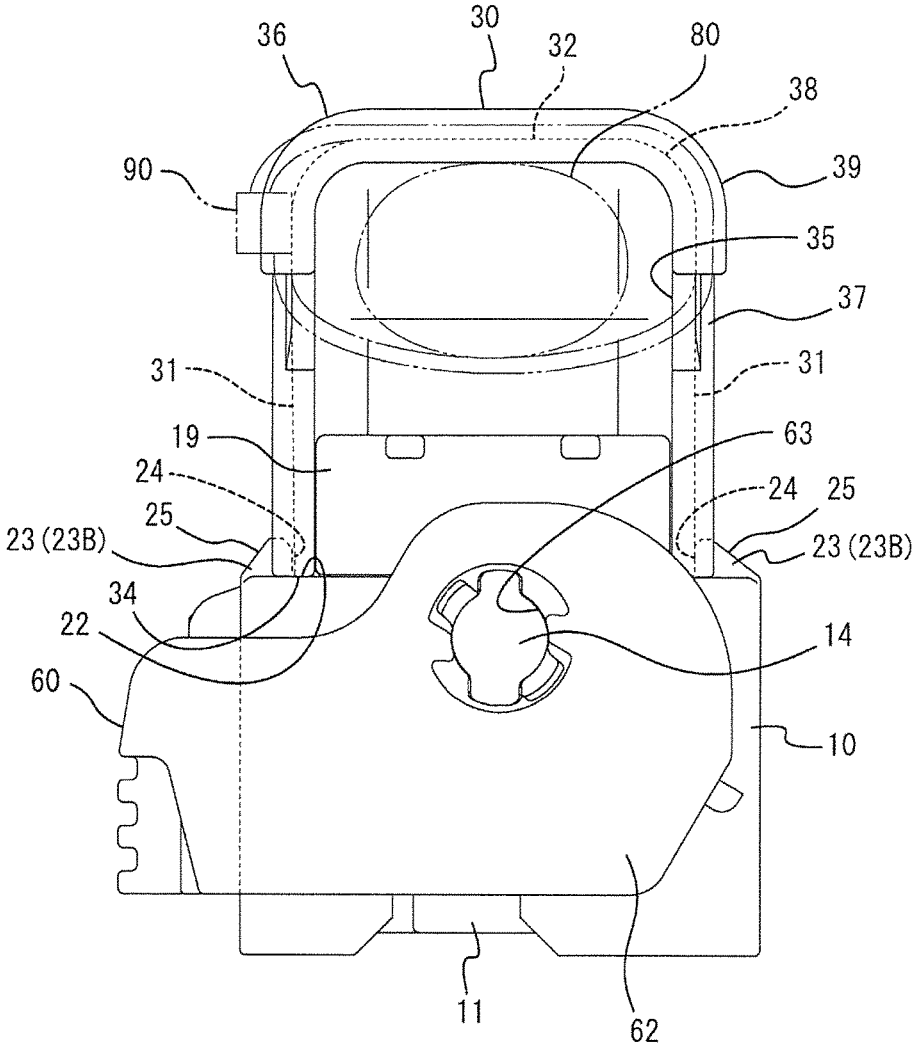
FIG. 2 is a back view of the connector.

A connector of this embodiment includes a housing 10, a cover 30 to be assembled with the housing 10 and a lever 60 to be mounted rotatably on the housing 10. In the following description, a left side of each figure excluding FIG. 2 is referred to as a front concerning a front-rear direction and a vertical direction is based on a vertical direction of each figure excluding FIGS. 3 and 4.

Figure 1:
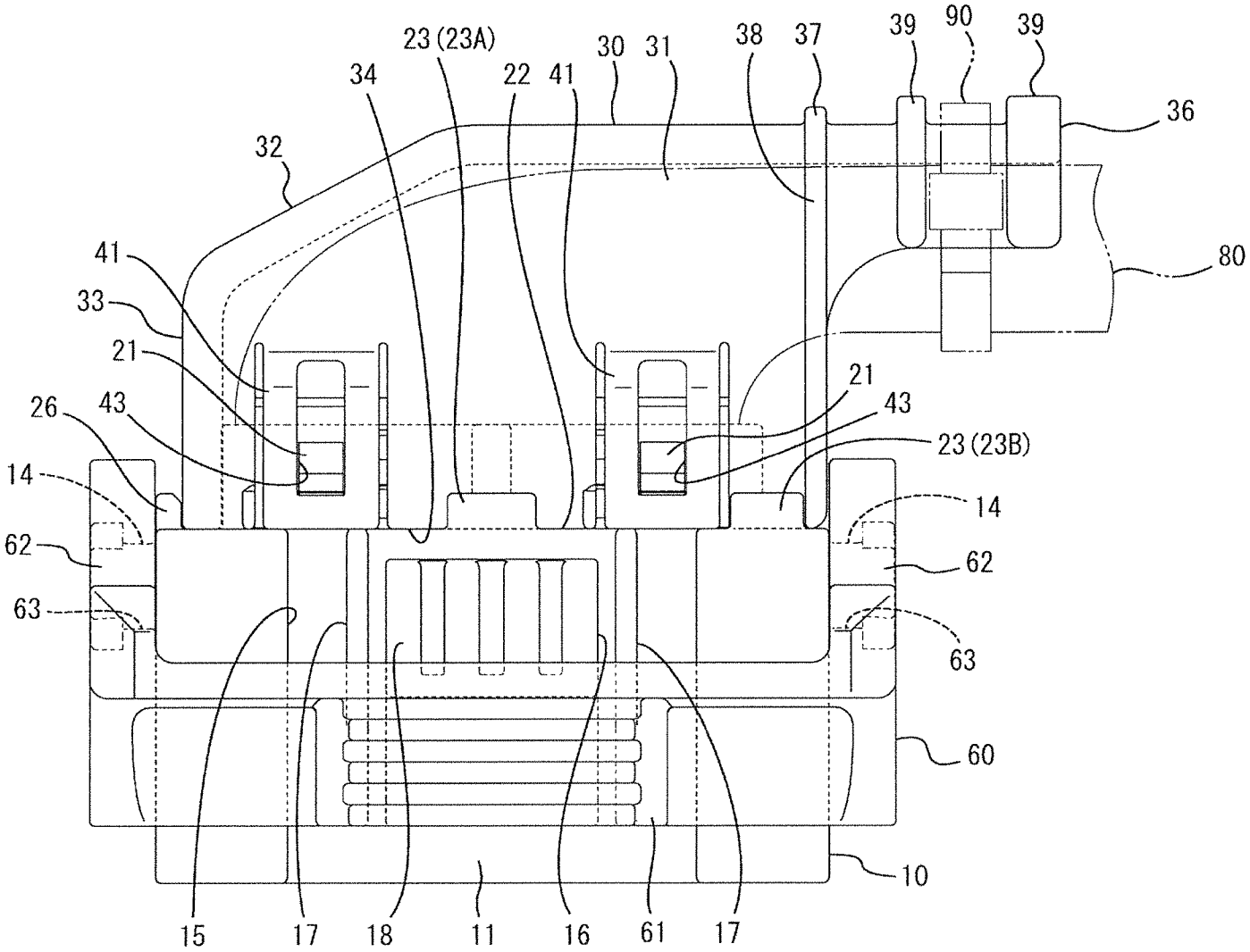
FIG. 1 is a side view of a connector according to one embodiment of the present invention.
Figure 3:
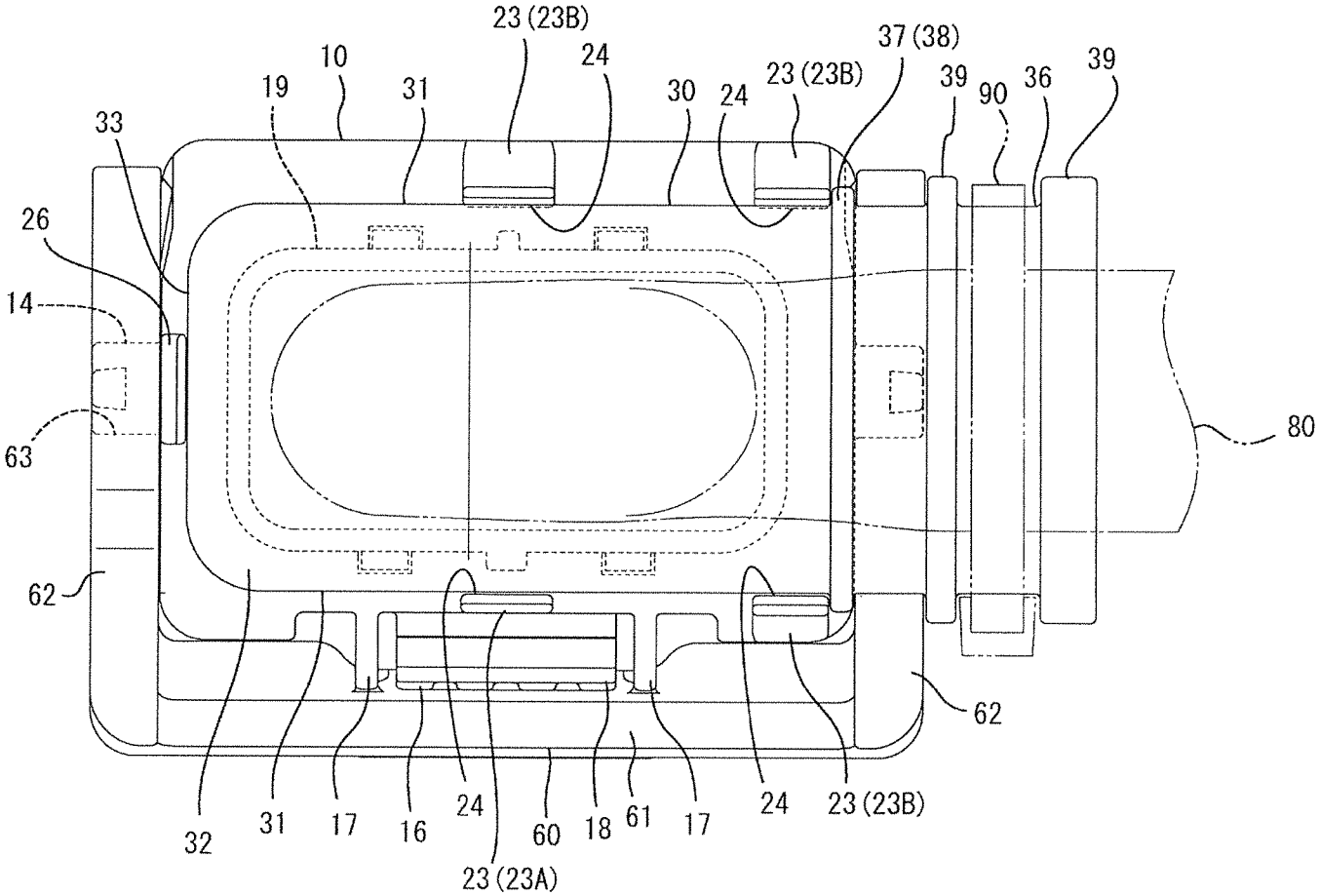
FIG. 3 is a plan view of the connector.
Figure 4:
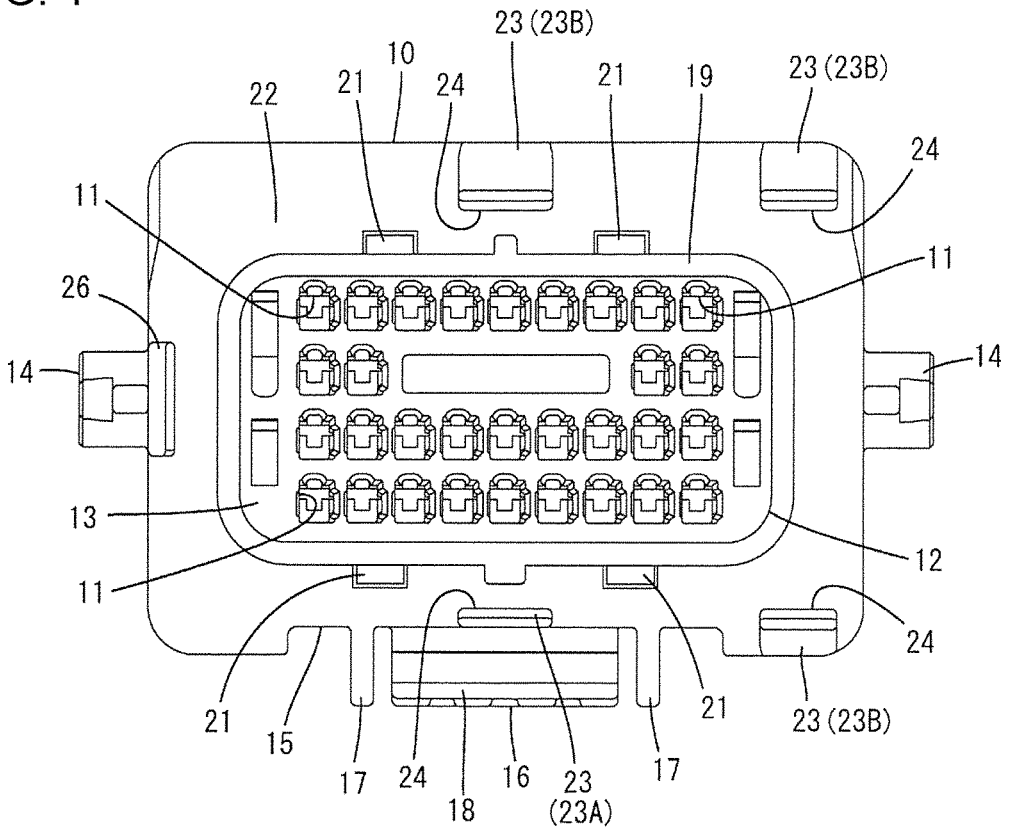
FIG. 4 is a plan view of a housing.
Figure 5:
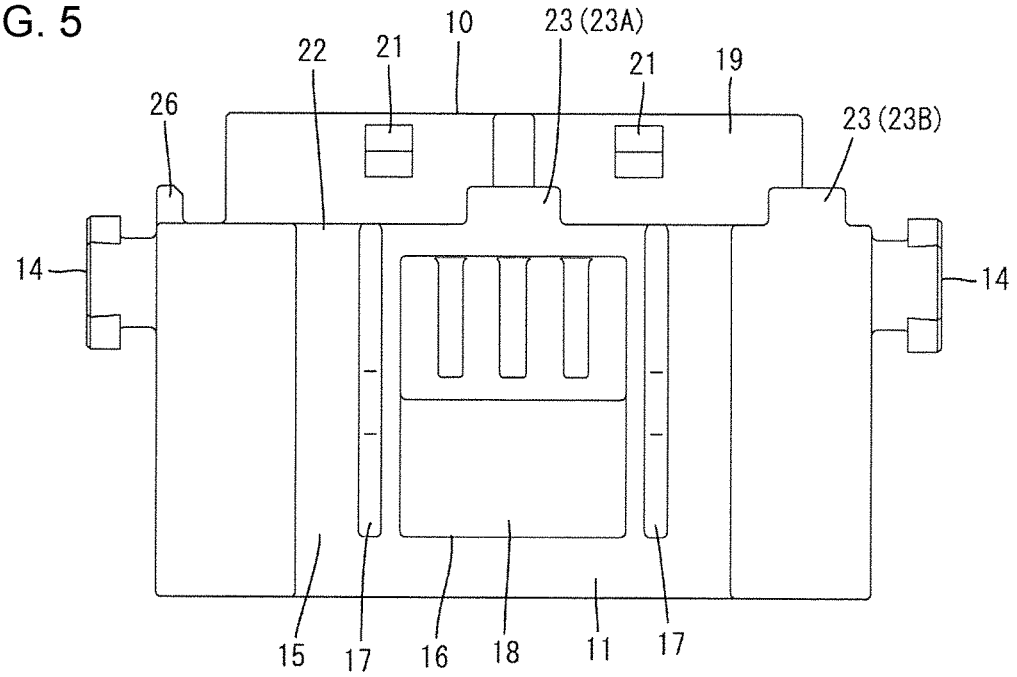
FIG. 5 is a side view of the housing.

The housing 10 is made of synthetic resin and includes, as shown in FIG. 4, a housing body 12 having cavities 11. An unillustrated terminal fitting is inserted into each cavity 11. The terminal fitting is connected to an end part of a wire 80. Each wire 80 extends up from a wire extending surface 13 serving as the upper surface of the housing body 12. Support shafts 14 project on both front and rear surfaces of the housing body 12. Each support shaft 14 has a substantially cylindrical shape and constitutes a pivot point of the lever 60. The lever 60 is made of synthetic resin, composed of an operating portion 61 extending in the front-rear direction and two substantially parallel arms 62 projecting from front and rear ends of the operating portion 61, as shown in FIGS. 1 and 3. The arms 62 are held on the housing 10 by being mounted over the housing body 12 from the front of FIG. 1 and fitting the support shafts 14 into bearing portions 63 (see FIG. 2) of the arms 62. The lever 60 can exhibit a cam action with a mating connector for pulling the mating connector to the housing 10 and into a properly connected state by rotating about the support shafts 14 between a state where the operating portion 61 is on one side and a state where the operating portion 61 is on the side of the cover 30.

A side surface of the housing body 12 that is covered by the operating portion 61 of the lever 60 includes a recess 15 that is recessed slightly from both end parts in the front-rear direction. As shown in FIG. 4, a locking portion 16 is provided on a bottom surface of the recess 15. The locking portion 16 has two ridges 17 extending in the vertical direction while being spaced apart in the front-rear direction, and a locking body 18 arranged between the ridges 17. The locking body 18 is a deflectable and deformable flat plate that functions to lock and hold the lever 60.

As shown in FIG. 4, a surrounding portion 19 for surrounding projects up on the upper surface of the housing body 12 and surrounds the outer periphery of the wire extending surface 13. The surrounding portion 19 has a substantially rectangular shape with four rounded corners when viewed from above, and the wire extending surface 13 is arranged inside. Front and rear lock receiving portions 21 are provided on each of the left and right sides (long sides) of the outer peripheral surface of the surrounding portion 19. The lock receiving portion 21 is in the form of a claw projecting out and has an upper surface inclined down toward an outer side and a lower surface arranged substantially horizontally.

As shown in FIG. 4, a part of the upper surface of the housing body 12 on an outer peripheral side of the surrounding portion 19 serves as a contact surface 22 that contacts a later-described opening end 34 of the cover 30. The contact surface 22 is flat and extends substantially along the front-rear direction. Opening restricting portions 23 project up on the contact surface 22 of the housing body 12. Front and rear opening restricting portions 23 are disposed on each of both left and right end parts of the contact surface 22 and are disposed at a rear end position and at a center position in the front-rear direction on each of the both left and right end parts of the contact surface 22. One opening restricting portion 23A is arranged adjacent to the recess 15 of the housing body 12. This opening restricting portion 23A is in the form of a plate piece extending along the front-rear direction and has an outer surface continuous from the bottom surface of the recess 15 without any step. The remaining three opening restricting portions 23B differ in size, but are shaped similarly, as described later.

As shown in FIG. 2, an inner part of each opening restricting portion 23 has a flat restricting surface 24 extending along the vertical direction. The restricting surfaces 24 of the respective opening restricting portions 23 face the outer surfaces of both side plates 13 of the cover 30 to be described later and restrict an expanding movement of the cover by contacting the outer surfaces of both side plates 31 when the side plates 31 are going to expand outward. Further, the front and rear end surfaces of the respective opening restricting portions 23 are arranged upright along the vertical direction. The rear end surfaces of the rear opening restricting portions 23B are arranged to contact a later-described rib 37 of the cover 30 and function to restrict a forward movement of the cover 30.

As shown in FIG. 2, each of the three opening restricting portions 23B has an inclined outer surface 25 inclined gradually in toward an upper side from a base end connected to the contact surface 22. Each opening restricting portion 23 has a substantially right triangular cross-sectional shape reduced in thickness toward the upper side formed by the restricting surface 24 and the inclined surface 25.

As shown in FIGS. 1 and 3, one stopper 26 projects up on the contact surface 22 of the housing body 12. The stopper 26 is a plate disposed at a lateral center position of a front end part of the contact surface 22 and extends along a lateral direction. The inner rear surface of the stopper 26 can contact the front end of the cover 30.

Next, the structure of the cover 30 is described. The cover 30 is made of synthetic resin and, as shown in FIGS. 2, 3 and 6, is cap-shaped as a whole and includes two the side plates 31 arranged on both left and right sides, a back plate 32 mounted between the upper ends of the side plates 31 to close the upper ends and a front plate 33 connected to the back plate 32 and mounted between the front ends of the side plates 31 to close the front ends.

Figure 6:
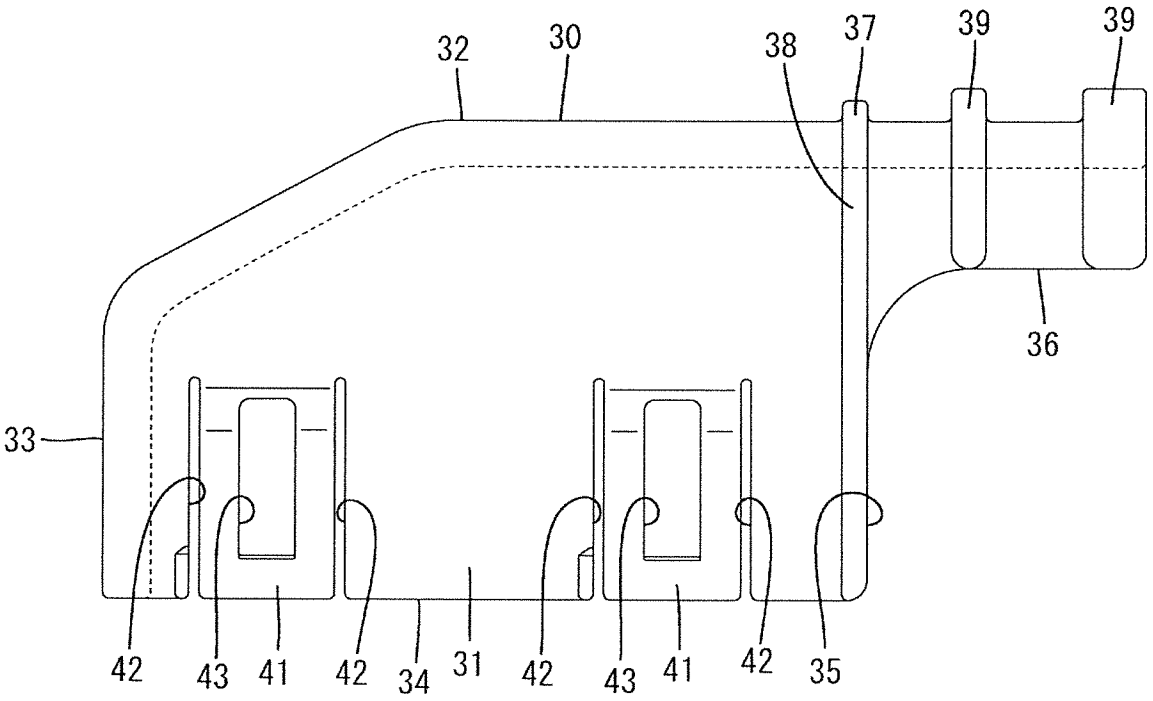
FIG. 6 is a side view of a cover.

As shown in FIG. 6, a rear part of the back plate 32 is arranged substantially along the front-rear direction, and a front part thereof is arranged obliquely down toward the front. Front parts of the side plates 31 have a vertical height gradually reduced toward the front in conformity with the shape of the back plate 32. Further, the front plate 33 is arranged to be upright along the vertical direction. The lower end of the cover 30 is formed as an opening end 34 having a substantially U-shaped cross-section and continuous from the side plates 31 to the front plate 33 substantially at the same height (see FIG. 2).

As shown in FIG. 2, the rear surface of the cover 30 communicates with an inner space of the opening end 34 and forms a wire pull-out opening 35 through which each wire 80 is pulled out. Further, as shown in FIG. 6, a wire draw-out portion 36 projects rearward on an upper end of a rear part of the cover 30. The wire draw-out portion 36 is connected integrally to the side plates 31 and the back plate 32 and has a downwardly open substantially U-shaped cross-section that defines an upper part of the wire pull-out opening 35.

The cover 30 bends the respective wires 80 extending up from the wire extending surface 13 of the housing body 12 rearward while covering the wires 80, and the respective wires 80 are pulled out to outside through the wire pull-out opening 35. As shown in FIGS. 1 and 2, the wires 80 pulled out form the wire pull-out opening 35 are routed along the wire draw-out portion 36 and fixed to the wire draw-out portion 36 via a fixing member 90, such as a binding band or tape.

As shown in FIGS. 2 and 6, the substantially U-shaped rib 37 (forward movement restricting portion) is provided on an opening edge of the wire pull-out opening 35 of the cover 30 and extends in a circumferential direction from the side plates 31 to the back plate portion 32. The rib 37 has a constant substantially rectangular cross-sectional shape in the circumferential direction at the same position in the front-rear direction, and has a partitioning portion 38 partitioning between a body of the cover 30 and the wire draw-out portion 36. The rigidity of the opening edge of the wire pull-out opening 35 of the cover 30 is enhanced by the rib 37, so that an opening shape of the wire pull-out opening 35 is kept constant.

Two substantially U-shaped restricting ribs 39 are provided on a rear end part and an intermediate part in the front-rear direction on the outer peripheral surface of the wire draw-out portion 36 and extend in the circumferential direction. Each restricting rib 39 has a larger projecting dimension than the rib 37. The fixing member 90 circles the respective wires 80 over the outer peripheral surface of the wire draw-out portion 36 at a position between the restricting ribs 39 with a positional deviation in the front-rear direction restricted.

Each of the side plates 31 of the cover 30 is provided with front and rear locks 41. As shown in FIG. 6, each lock 41 is deflectable and deformable between two slits 42 formed in the side plate 31. The slits 42 extend in the vertical direction while being spaced apart in the front-rear direction in the side plate 31, and the lower ends thereof are open to the opening end 34. Each lock 41 is a rectangular frame cantilevered down from an upper end corresponding to the back ends of the slits 42, and includes a lock hole 43 having a vertically long rectangular shape inside. The lock receiving portion 21 is fit into the lock hole 43.

In assembling, the cover 30 is mounted on the housing 10 from above. In the process of assembling the cover 30, the locks 41 interfere with the lock receiving portions 21 to be deflected and deformed out. When the assembling of the cover 30 is completed, the locks 41 resiliently return and the lock receiving portions 21 are fit into the lock holes 43 to hold the cover 30 on the housing 10 in a state where separation is restricted. Further, as the cover 30 is assembled, the wires 80 extending from the wire extending surface 13 of the housing 10 are bent forcibly rearward and pulled out rearwardly through the wire pull-out opening 35. The respective pulled-out wires 80 are fixed to the wire draw-out portion 36 by the fixing member 90.

In a state where the locks 41 lock the lock receiving portions 21 by completing the assembling of the cover 30 described above, the opening end 34 of the cover 30 is placed to contact along the contact surface 22 of the housing 10, as shown in FIGS. 1 and 3. Further, the front surface of the front plate 33 of the cover 30 is arranged to contact and face the stopper 26 of the housing 10, and the front end surface of the rib 37 of the cover 30 is arranged to contact and face the rear opening restricting portions 23.

Further, as shown in FIGS. 2 and 3, the restricting surfaces 24 of the respective opening restricting portions 23 of the housing 10 are arranged to contact along the outer surfaces of the side plates 31 of the cover 30. As shown in FIG. 1, the respective opening restricting portions 23 are arranged to correspond to positions proximate to the respective locks 41 of the cover 30 on both front and rear sides. Specifically, the rear locks 41 are adjacent at positions immediately before the rear opening restricting portions 23, and the front opening restricting portions 23 are correspondingly arranged behind the front locks 41 although being slightly spaced apart.

If the respective wires 80 pulled out from the wire pull-out opening 35 of the cover 30 are swung in the vertical or lateral direction, the cover is subjected to external forces, such as an expanding force for laterally expanding the side plates 31 of the cover 30, a twisting force for twisting the cover 30 and a shifting force for moving the cover 30 forward. Then, the respective locks 41 may be spaced apart and detached from the corresponding lock receiving portions 21 and the cover 30 may be separated from the housing 10.

However, in the case of this embodiment, the front plate 33 of the cover 30 contacts the stopper 26 and the rib 37 of the cover 30 contacts the rear opening restricting portions 23 to suppress a forward movement of the cover 30 by the above shifting force.

Further, parts of the both side plates 31 of the cover 30 on the side of the opening end 34 contact the respective opening restricting portions 23 in opening directions of the side plates 31 to suppress the expansion of the cover 30 by the above expanding force and twisting force. In this case, the twisting force can be suppressed by the contact of the rib 37 of the cover 30 with the rear opening restricting portions 23.

As described above, the opening restricting portions 23 face the outer surfaces of the side plates 31 of the cover 30. Thus, even if the respective wires 80 pulled out from the wire pull-out opening 35 are swung and external forces act on the cover 30 in a twisting direction and an expanding direction, the outer surfaces of the side plates 31 of the cover 30 contact the respective opening restricting portions 23 to prevent the expansion of the side plates 31 of the cover 30. As a result, a state where the locks 41 lock the lock receiving portions 21 is maintained and the separation of the cover 30 from the housing 10 is restricted reliably. In addition, since the opening restricting portions 23 are arranged at the positions corresponding to the respective locks 41, the state where the locks 41 lock the lock receiving portions 21 is maintained more reliably.

A forward positional deviation of the cover 30 from the housing 10 is prevented by the contact of the rear opening restricting portions 23 with the front end of the rib 37. The opening restricting portions 23 have both a function of preventing a positional deviation of the cover 30 and a function of preventing the expansion of the cover 30 as just described. Thus, an entire configuration can be simplified as compared to the case where both functions are provided individually.

The opening shape of the wire pull-out opening 35 of the cover 30 is maintained by the rib 37 and, eventually, an opening width of the opening end 34 communicating with the wire pull-out opening 35 also is maintained, the expansion of the cover 30 is prevented more reliably prevented. Furthermore, since the rib 37 has a function of maintaining the opening shape of the wire pull-out opening 35, a function of preventing a positional deviation of the cover 30 and a function of preventing the expansion of the cover 30, the entire configuration can be simplified.

Other embodiments are briefly described below.

The cover may include, instead of the rib, a dedicated structural part configured to contact the opening restricting portions to have a forward movement restricted.

The number of the opening restricting portions is arbitrary and only one opening restricting portion may be provided on the housing.

The stopper may be omitted from the housing if a forward movement of the cover can be restricted only by the contact of the rear opening restricting portions with the rib.

The invention is applicable also to connectors having no lever.

LIST OF REFERENCE SIGNS

10 . . . housing
13 . . . wire extending surface
21 . . . lock receiving portion
23 . . . opening restricting portion
30 . . . cover
34 . . . opening end
35 . . . wire pull-out opening
37 . . . rib (forward movement restricting portion)
41 . . . lock
80 . . . wire

The invention claimed is:

1. A connector, comprising:

a housing having a wire extending surface, a lock receiving portion disposed outward of the wire extending surface, and a contact surface outward of the wire extending surface; and a cover in the form of a cap for covering a wire extending from the wire extending surface, the cover including opposite side walls forming a wire pull-out opening configured such that the wire is pulled out therethrough, the side walls further forming an opening end configured to come into contact with the contact surface of the housing along a front-rear direction, a lock configured to restrict separation from the housing by locking the lock receiving portion, and a forward movement restricting portion spaced from the lock and extending along an opening edge of the wire pull-out opening wherein:

the housing includes opening restricting portions arranged to contact and face a front end of the forward movement restricting portion and to face outer surfaces of the side walls of the cover.

2. The connector of claim 1, wherein the forward movement restricting portion is a rib extending along an opening edge of the wire pull-out opening.

3. The connector of claim 1, wherein the cover is provided with a plurality of the locks, and the opening restricting portions are arranged at positions corresponding to the respective locks.

4. A connector, comprising:

a housing having a wire extending surface, a surrounding portion surrounding the wire extending surface, a contact surface outward of the surrounding portion, and first and second opening restricting portions projecting from the contact surface at positions outward of the surrounding portion; and a cover in the form of a cap for covering a wire extending from the wire extending surface, the cover including opposite side walls forming a wire pull-out opening configured such that the wire is pulled out therethrough and forming an opening end configured to come into contact with the contact surface of the housing along a front-rear direction at positions between the surrounding portion and the opening restriction portions, a lock configured to restrict separation from the housing by locking the lock receiving portion, and a forward movement restricting portion extending along the wire pull-out opening so that a front end surface of the forward movement restricting portion faces and contacts both the first and second opening restricting portions.

* * * * *